United States Patent [19]

Hand et al.

[11] Patent Number: 4,563,005

[45] Date of Patent: Jan. 7, 1986

[54] APPARATUS FOR EVALUATING BASEBALL PITCHING PERFORMANCE

[75] Inventors: Richard A. Hand, Arlington; John L. Watkins, Plano, both of Tex.

[73] Assignee: Fortune 100, Inc., Arlington, Tex.

[21] Appl. No.: 569,779

[22] Filed: Jan. 10, 1984

[51] Int. Cl.[4] ..... A63B 71/02; A63B 71/06

[52] U.S. Cl. ..... 273/26 R; 273/181 H; 273/185 R; 273/371; 434/247

[58] Field of Search ..... 273/25, 26 R, 26 A, 273/26 B, 26 D, 32 H, 181 H, 181 E, 181 A, 181 G, 186 R, 186 A, 186 B, 186 C, 186 RA, 184 R, 185 R, 185 A, 185 B, 317, 371; 434/247

[56] References Cited

U.S. PATENT DOCUMENTS

| | | | |
|---|---|---|---|
| 2,113,899 | 4/1938 | Oram | 273/26 A |
| 2,943,141 | 6/1960 | Knight | 273/26 A |
| 3,157,399 | 11/1964 | Gaudet | 273/26 A |
| 4,150,825 | 4/1979 | Wilson | 273/195 A |
| 4,461,477 | 7/1984 | Stewart | 273/26 R |

*Primary Examiner*—Richard C. Pinkham

*Assistant Examiner*—MaryAnn Stoll Lastova

*Attorney, Agent, or Firm*—Glaser, Griggs & Schwartz

[57] ABSTRACT

Apparatus for detecting and computing the location of a baseball as it is pitched over a plate is disclosed. Infrared receivers are disposed at corner locations on opposite sides of a target zone which is aligned with the plate. First and second arrays of infrared emitters are mounted on opposite sides of the target zone for transmitting infrared light pulses to the opposite corner receivers. The infrared emitters are sequentially energized and transmit infrared pulse signals having relatively short durations in a scan cycle. Digital data words representative of the reception and nonreception by the receivers of the optical pulse signals are generated during each pulse interval of the scan cycle. Computer circuitry calculates the coordinates of the baseball within the target zone as a function of predetermined angular data retrieved computer memory. The computer memory is preprogrammed with a table of angular data corresponding to each receiver data word and the particular emitter pulse interval in which it occurs.

9 Claims, 10 Drawing Figures

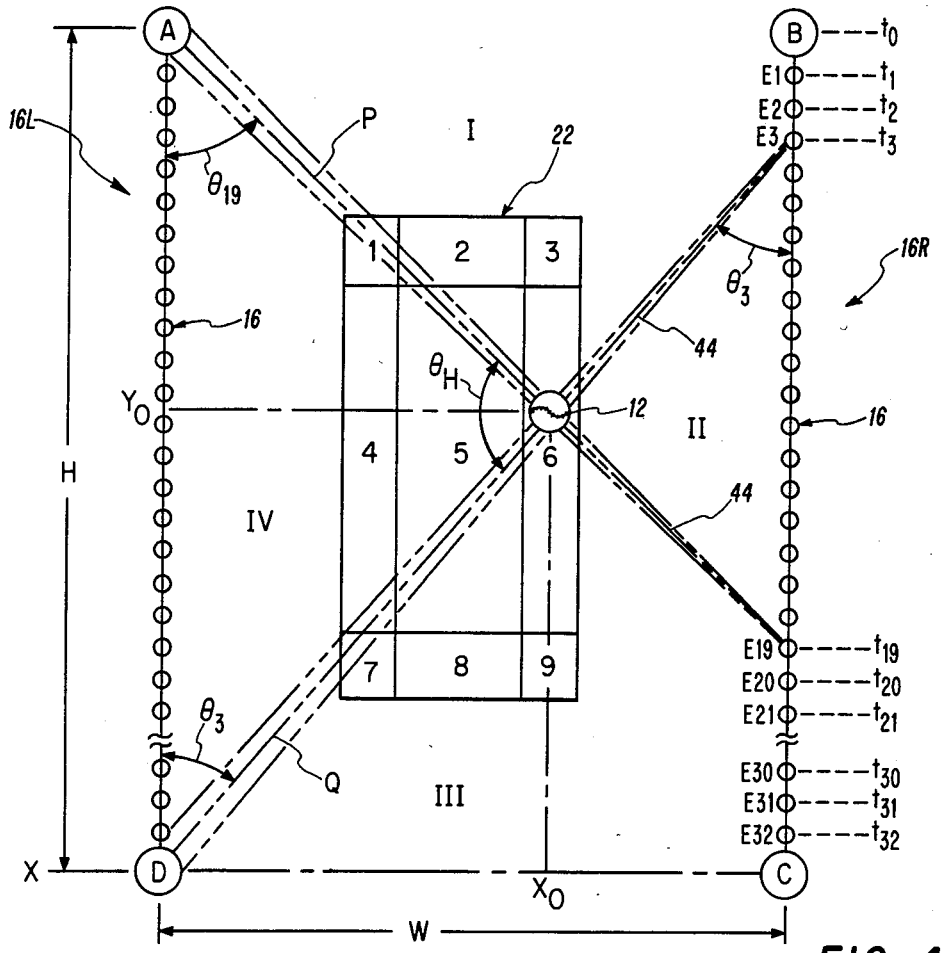
FIG. 4
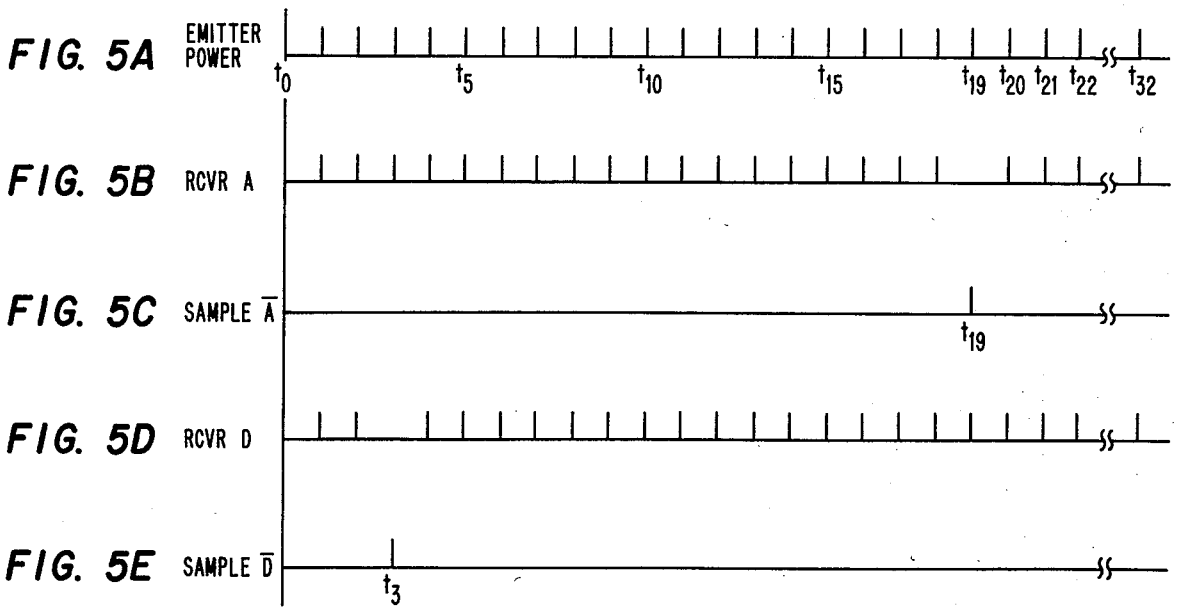

APPARATUS FOR EVALUATING BASEBALL PITCHING PERFORMANCE

BACKGROUND OF THE INVENTION

1. Field of the Invention

This invention relates generally to systems for detecting and computing the coordinates of a projectile in a target zone, and in particular to targeting apparatus for evaluating baseball pitching performance.

2. Description of the Prior Art

A continuing search is under way for new and innovative methods to enhance the performance of athletes to their highest level. The use of "radar guns" to measure the velocity of a pitched baseball is an example of a recent application of technology. However, its use has had only a minimal impact upon the training and perfection of pitching ability.

The goal of the pitcher is to deliver a baseball at a high velocity across the plate within the strike zone, but in the strike areas where hits occur less frequently. In pitching strategy, the pitcher attempts to avoid a hit by creating variations of velocity, movement of the baseball, and location of the baseball as it penetrates the strike zone. The most difficult effect to accomplish with reliability is variation of location of the baseball as it penetrates the strike zone. It is believed that the majority of baseball pitchers learn the art of throwing to a specific location only after they lose their ability to control velocity or movement or both. There is a need, therefore, for training apparatus which can be used by a baseball pitcher to improve his performance in pitch delivery and placement.

OBJECTS OF THE INVENTION

It is, therefore, the principal object of the present invention to provide a baseball training system for detecting and computing the location of a baseball as it is thrown through a strike zone.

A related object of the invention is to provide a baseball practicing tool which provides the baseball pitcher with detailed analysis of his performance in pitch placement, speed and consistency.

SUMMARY OF THE INVENTION

Apparatus for detecting and computing the location of a baseball as it is pitched over a plate includes infrared receivers disposed at corner locations on opposite sides of a target zone which is aligned with the plate. First and second arrays of infrared emitters are mounted on opposite sides of the target zone for transmitting infrared light pulses to the opposite corner receivers. The infrared emitters are sequentially energized and transmit optical pulse signals having relatively short durations in a scan cycle. Digital data words representative of the reception and nonreception by the receiver of the optical pulse signals are generated during each pulse interval of the scan cycle.

Computer circuitry calculates coordinates of a point within the target zone as a function of angular data derived from a set of predetermined angular values stored within computer memory. Each angular value in the set corresponds with the aspect angle of an optical beam traversing the target zone from an energized emitter on one side of the target zone to a receiver on the opposite side of the target zone. The angular values are selected by the computer with reference to each receiver data word and the particular time interval within the scan cycle in which it is generated. The generation of two digital data words corresponding to the outputs of two receivers uniquely determines the quadrant location of the projectile. The rectilinear coordinates of the projectile are calculated from a pre-recorded angular value associated with each digital data word for a particular emitter time interval, and with reference to the fixed, known dimensions of the target zone. The X and Y coordinates of the projectile are determined from calculations based upon the Law of Sines.

The foregoing and other objects, advantages and features of the invention will hereinafter appear, and for purposes of illustration, but not of limitation, an exemplary embodiment of the invention is shown in the appended drawings.

BRIEF DESCRIPTION OF THE DRAWINGS

FIG. 4 is a simplified elevation view of the detector assembly shown in FIG. 1, illustrating the location of the target zone between the emitters and receivers;

FIGS. 5A, 5B, 5C, 5D and 5E are timing diagrams which illustrate one aspect of operation of the invention; and, FIG. 6 is a schematic block diagram of the detecting and computing system of the invention.

DETAILED DESCRIPTION OF THE PREFERRED EMBODIMENT

Figure 1:
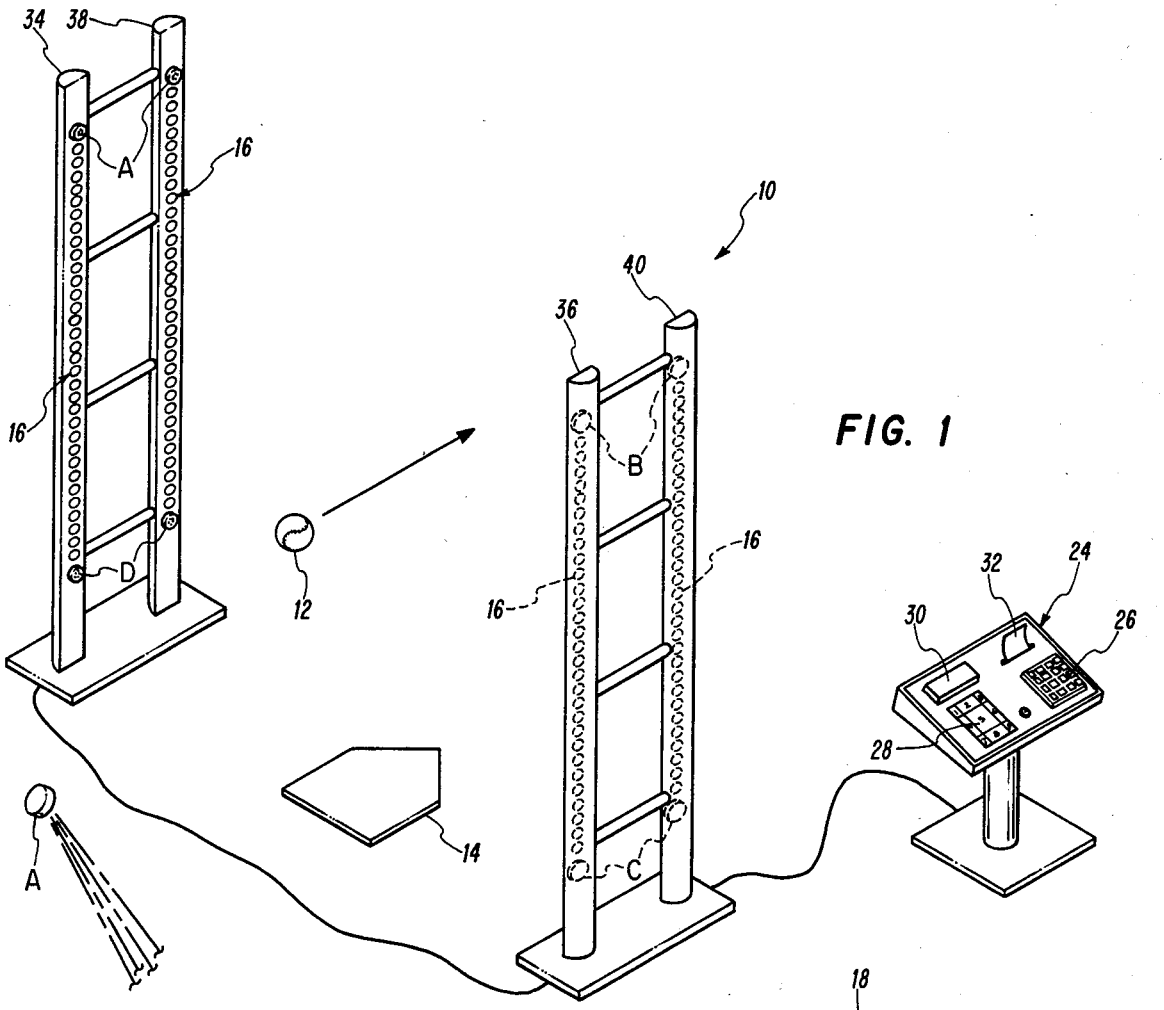
FIG. 1 is a perspective view of the detecting and computing system of the invention.

In the description which follows, like parts are marked throughout the specification and drawings with the same reference numerals, respectively. In some instances, proportions have been exaggerated in order to more clearly depict certain features of the invention.

Figure 3:
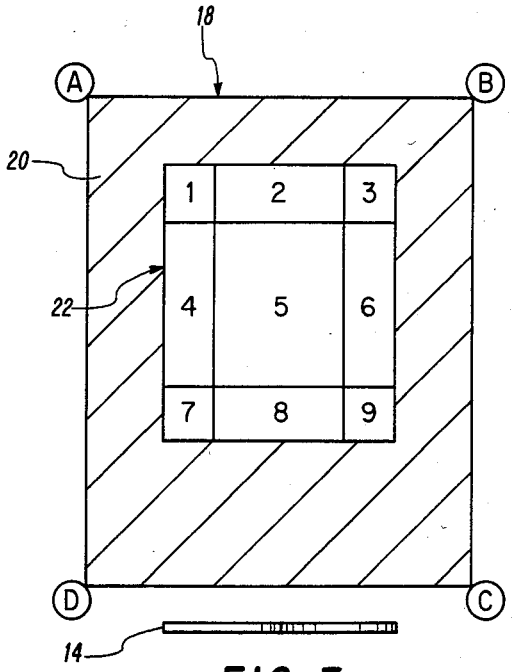
FIG. 3 is a schematic elevation view which illustrates the strike region and ball region within the target zone above a baseball plate.

Referring now to FIG. 1, a baseball practice system 10 for detecting and computing the position of a baseball 12 as it moves across a pitching plate 14 utilizes parallel arrays of infrared emitters 16 and infrared receivers A, B, C, and D. The infrared receivers A, B, C and D are positioned at the four corners of a rectangular target zone 18 and the parallel arrays of emitters are aligned with the Y-axis of the target zone, as illustrated in FIG. 3. The target zone 18 is partitioned into a ball zone 20 and a strike zone 22. The strike zone 22 is further partitioned into nine strike areas 1–9. The X-Y axes define a plane which is substantially coincident with the strike zone 22.

Electrically coupled to the emitters and receivers is an operator control consol 24 which is programmable for practice and evaluation. The operator consol 24 includes a data input pad 26, a strike zone display panel 28, a velocity display 30 and a printer 32.

The emitter 16 and receivers A, B, C and D are mounted on upright support posts 34, 36 at the four corners of the target zone 22. The support posts are spaced apart by a distance W in alignment with the X-axis of the target zone, and the emitters 16 are spaced apart in alignment with the Y-axis of the target zone through a distance H. There are 32 emitters and 2 receivers mounted on each support post. The emitters are spaced approximately 1.9 inches center to center.

The emitters of the left side array and the emitters of the right side array together with the receivers A, B, C and D define the boundary and corners of the target zone. A duplicate target plane is established by a second set of left and right emitter arrays and receivers A, B, C and D. The rear target zone is parallel with the front target zone, and is utilized to determine the velocity of the baseball 12 as will be discussed hereinafter.

Figure 2:
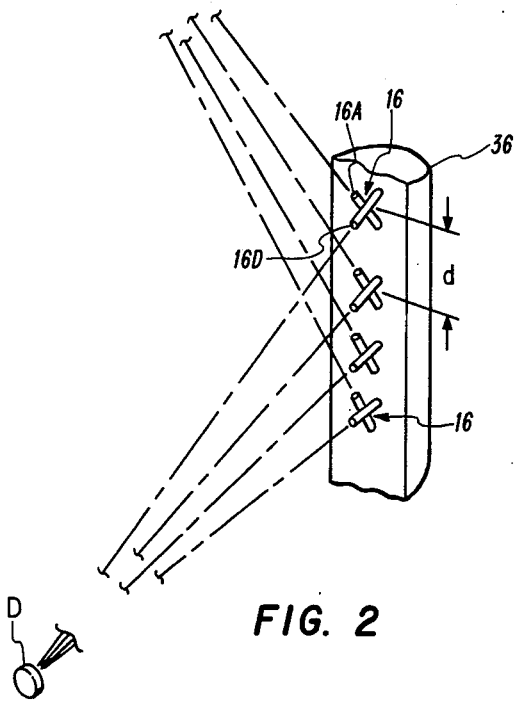
FIG. 2 is a partial perspective view of a portion of the detector assembly illustrated in FIG. 1.

There are 32 emitters 16 mounted on each post. Referring to FIG. 2, each emitter preferably comprises a first emitter 16A aligned for optical communication with the receiver A on post 34, and a second emitter 16D aligned with receiver D on post 34. The spacing d between each emitter pair is approximately 1.9 inches.

The optical receivers A, B, C and D are preferably rated for operation in the infrared spectrum at 500 KHZ with a sensitivity of 25 nanowatts. The emitters 16 are light emitting diodes which emit light within the infrared spectrum.

Referring now to FIG. 4, left and right emitter arrays 16L, 16R form laterally opposite boundries for the target zone 22. A pulse circuit 42 (FIG. 6) is coupled to the emitters of each array for sequentially energizing the emitters of each array for the purpose of transmitting a short duration optical pulse signal from each emitter during a scan cycle. The scan cycle is controlled by a central processing unit (CPU) with the assistance of a program stored in a read only memory (ROM).

The optical receivers A, B, C and D are coupled through a parallel data input port and through the data bus to the CPU and RAM for generating a sequence of digital data words representative of the reception and nonreception by the receivers of the infrared pulse signals emitted during each pulse interval of the scan cycle. The duration of each pulse interval is approximately seven microseconds, and the time required to scan a complete cycle from top to bottom is approximately 475 microseconds.

As the baseball 12 penetrates the forward target zone as illustrated in FIG. 4, the infrared light beam 44 transmitted by the emitter 16 located at emitter station E3 is blocked by the baseball 12 so that the receiver sample $\overline{D}$ output at time interval t3 is logic ONE, as illustrated in FIG. 5E. Because the scan cycle is relatively fast, for example 475 microseconds per scan, the emitters 16 are sequentially cycled several times before the baseball 12 exits the plane of the target zone. Accordingly, the light emitted by the emitter 16 which is in emitter position E19 is also obscured by the baseball 12 as it traverses the target plane, thereby blocking the light beam and preventing it being received by receiver A in the left array 16L. Accordingly, receiver sample $\overline{A}$ has a logic ONE output at time interval $T_{19}$ as illustrated in FIG. 5C.

The digital data words corresponding to penetration in quadrants I, II, III and IV, respectively, are illustrated in Table 1. The sequence of digital data words generated for the scan associated with the example of FIG. 4 is summarized in Table 2.

Figure 6:
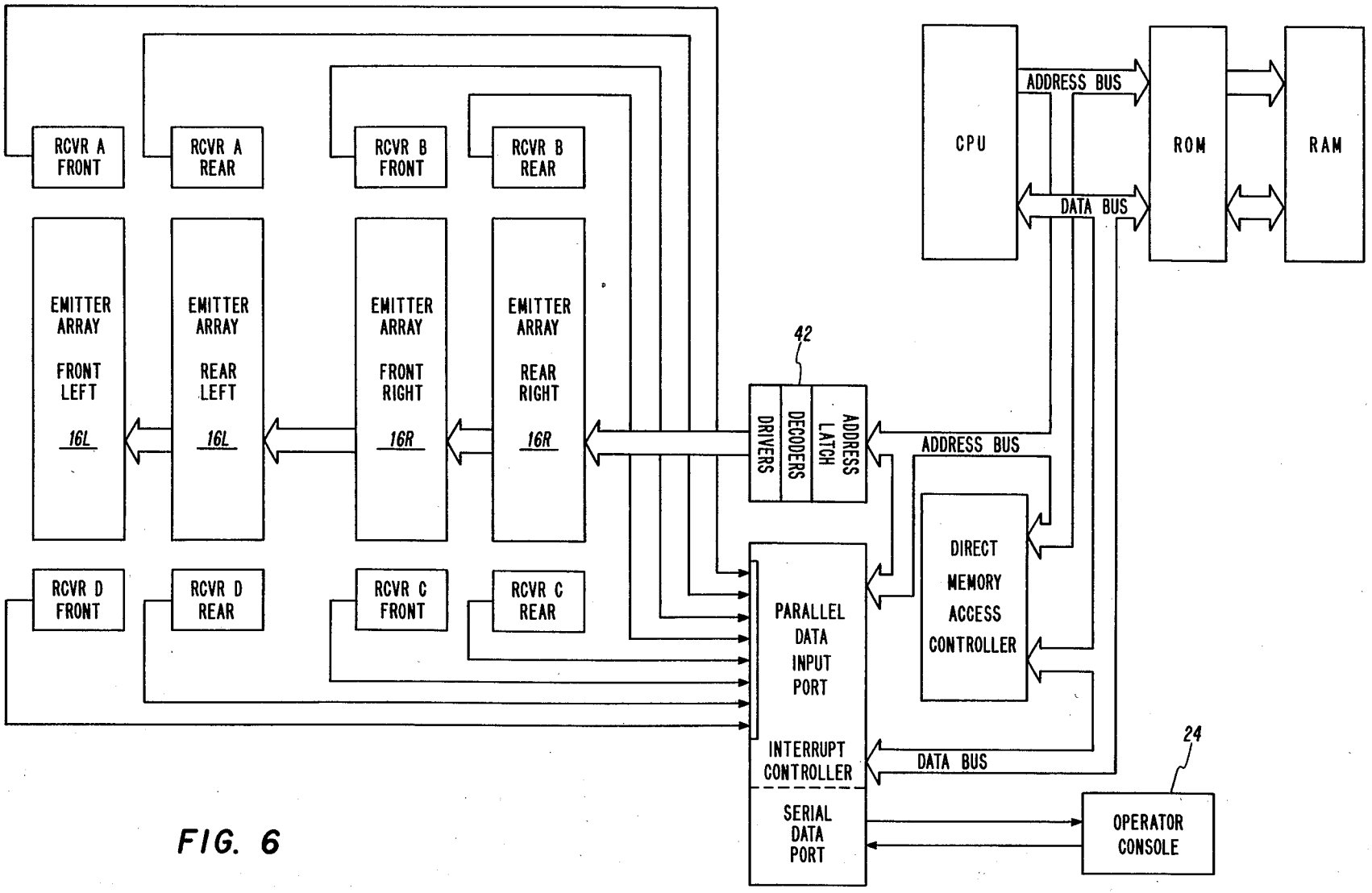

The control circuit and computer means illustrated in FIG. 6 calculate the coordinates of the baseball 12 as a function of certain angular data derived from a set of predetermined angular values stored in the ROM. Each angular value stored in ROM memory corresponds with the aspect angle, for example $\theta_3$ as illustrated in FIG. 4, of an optical beam 44 traversing the target zone from an energized emitter at emitter position E3 on one side of the target zone to receiver D on the opposite side of the target zone. The aspect angle $\theta$ is measured from the Y-axis between an emitter and a receiver. These angular values are determined by the spacing (d) between emitter pairs, the width W between the left and right arrays, and the height H of the arrays. Each particular value is stored as a scalar quantity A1–A32, B1–B32, C1–C32 and D1–D32, as illustrated in Table 3. These scalar values are stored within the ROM and are selected by the computer with reference to each particular receiver data word and the particular time interval within the scan cycle in which it is generated.

Referring to the example illustrated in FIG. 4, $\theta_3$ and $\theta_{19}$ are known quantities and are selected from ROM memory to be utilized to calculate the X and Y coordinate location ($X_o$, $Y_o$) of the baseball 12. Applying the laws of trigonometry, $Xo = Q \sin \theta_3$, and $Yo = Q \cos \theta_3$. By the Law of Sines, $$\frac{Q}{\sin \theta_{19}} = \frac{P}{\sin \theta_3} = \frac{H}{\sin \theta_H}$$

$\theta_H$ is a known quantity, being the difference of $180° - \theta_{19} - \theta_3$. Additionally, H is a known height. Applying the Law of Sines and substituting the known quantities.

$$Y_o = \frac{H \sin \theta_{19} \cos \theta_3}{\sin \theta_H} \quad X_o = \frac{H \sin \theta_{19} \sin \theta_3}{\sin \theta_H}$$

The foregoing algebraic operations are performed by the computer circuitry as illustrated in FIG. 6 during each scan interval. The ($X_o$, $Y_o$) coordinates are stored in the computer memory for further processing, for example for updating the strike zone display 28 on the operator's consol, and for entry into the printed record 24 for that particular pitching exercise.

The velocity of the baseball 12 as it traverses the forward and rear target zones is computed by dividing the separation distance between the parallel target zones by the elapsed transit time of the baseball 12. The computed velocity is indicated on the display 30 and is recorded by the printer 32 for each pitch.

The foregoing detecting and computing system 10 provides the baseball pitcher with detailed analysis of his performance in pitch placement, speed and consistency. The support posts on which the emitters and receivers are mounted are easily erectable on either side of the batter's box. The display and control consol provides instant feedback regarding speed, location, time, efficiency rating, strike/ball ratios and a wide variety of manually selected and computer initiated strike sequences.

The system is capable of operation in multiple practice modes. The first practice mode consists of pitches which are thrown at one or to all nine of the individual strike zones. In a repetitive accuracy mode, the pitcher selects the target zones one through nine to define his workout and then the number of pitches in his workout for that zone. All zones not selected by the control unit will be considered to be hit zones having a high hit probability. When the random accuracy mode is chosen, the pitcher selects only the number of pitches in the workout. The computer then selects a new target pattern on the control and display unit for each successive throw.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

TABLE 1

| QUADRANT | RCVR SAMPLE $\overline{A}$ | $\overline{B}$ | $\overline{C}$ | $\overline{D}$ |
|---|---|---|---|---|
| I | 1 | 0 | 0 | 0 |
| | 0 | 1 | 0 | 0 |
| II | 1 | 0 | 0 | 0 |
| | 0 | 0 | 0 | 1 |
| III | 0 | 0 | 0 | 1 |
| | 0 | 0 | 1 | 0 |
| IV | 0 | 0 | 1 | 0 |
| | 0 | 1 | 0 | 0 |

TABLE 2

| t | RCVR SAMPLE $\overline{A}$ | $\overline{B}$ | $\overline{C}$ | $\overline{D}$ |
|---|---|---|---|---|
| $t_1$ | 0 | 0 | 0 | 0 |
| $t_2$ | 0 | 0 | 0 | 0 |
| $t_3$ | 0 | 0 | 0 | 1 |
| $t_4$ | 0 | 0 | 0 | 0 |
| . | . | . | . | . |
| . | . | . | . | . |
| . | . | . | . | . |
| $t_{18}$ | 0 | 0 | 0 | 0 |
| $t_{19}$ | 1 | 0 | 0 | 0 |
| $t_{20}$ | 0 | 0 | 0 | 0 |
| . | . | . | . | . |
| . | . | . | . | . |
| . | . | . | . | . |
| $t_{32}$ | 0 | 0 | 0 | 0 |

TABLE 3

| RCVR SAMPLE $\overline{A}$ | $\overline{B}$ | $\overline{C}$ | $\overline{D}$ | $t_1$ | $t_2$ | $t_3$ | . . . | $t_{32}$ |
|---|---|---|---|---|---|---|---|---|
| 1 | 0 | 0 | 0 | A1 | A2 | A3 | . . . | A32 |
| 0 | 1 | 0 | 0 | B1 | B2 | B3 | . . . | B32 |
| 0 | 0 | 1 | 0 | C1 | C2 | C3 | . . . | C32 |
| 0 | 0 | 0 | 1 | D1 | D2 | D3 | . . . | D32 |

What is claimed is:

1. Apparatus for detecting the presence of a projectile in a target zone comprising, in combination:

an optical receiver disposed adjacent to a target zone;

an array of optical emitters disposed in spaced relation adjacent the target zone, each optical emitter of said array being aimed for optical communication with said receiver; and, a pulse circuit coupled to said emitters for sequentially energizing said emitters and emitting optical beam pulse signals to said receiver during a timed scan cycle.

2. Apparatus as defined in claim 1, including:

a control circuit coupled to said optical receiver for generating a sequence of digital data words corresponding with reception and non-reception by said receiver of said optical beam pulse signals.

3. Apparatus as defined in claim 2, including:

calculation means coupled to said control circuit for calculating the location of a point within the target zone as a function of angular data derived from a set of predetermined angular values, each angular value of the set corresponding with the aspect angle of an optical beam traversing the target zone from an energized emitter to said receiver.

4. Apparatus for detecting the presence of a projectile in a target zone comprising, in combination:

first and second optical receivers disposed in spaced relation adjacent a target zone;

a first array of optical emitters disposed in spaced relation adjacent the target zone, each emitter of said first array being aimed for optical communication with the first receiver;

a second array of optical emitters disposed in spaced relation adjacent the target zone, each emitter of said second array being aimed for optical communication with the second receiver; and, a pulse circuit coupled to the emitters of each array for sequentially energizing the emitters of each array and emitting optical beam pulse signals to said first and second receivers during a timed scan cycle.

5. Apparatus as defined in claim 4, including:

means coupled to said optical receivers for generating a sequence of digital data words corresponding with the reception and non-reception by said receivers of optical pulse signals emitted during each pulse interval of the scan cycle.

6. Apparatus as defined in claim 5, including:

calculation means coupled to said word generating means for calculating coordinates of a point within the target zone as a function of angular data derived from a set of predetermined angular values, each angular value of the set corresponding with the aspect angle of an optical beam traversing the target zone from an energized emitter on one side of the target zone to a receiver on the opposite side of the target zone, said angular values being indexed for selection by said calculation means as determined by the particular receiver data word generated during each pulse interval and the identity of the pulse interval within each scan cycle that the receiver data word is generated.

7. Apparatus as defined in claim 4, the optical emitters of the first and second arrays being disposed in pairs at a plurality of common stations, with one emitter in each pair being aimed at said first optical receiver and the other optical emitter of the pair at each station being aimed at said second optical receiver.

8. A method for detecting the presence of a projectile in a target zone comprising the steps:

sequentially emitting optical beams during a scan cycle of timed pulse intervals across a target zone by an array of optical emitters which are focused on a common receiver; and, generating of a sequence of digital data words representing the reception and non-reception by said common receiver of the optical beams emitted during each pulse interval in the scan cycle.

9. A method as defined in claim 8, including the step of:

calculating coordinates of a point within the target zone as a function of angular data derived from a set of predetermined angular values, each angular value of the set corresponding with the aspect angle of an optical beam traversing the target zone from an energized emitter on one side of the target zone to a receiver on the opposite side of the target zone, said angular values being indexed for selection as determined by the particular receiver data word generated during each pulse interval and the identity of the pulse interval within each timed sequence that the receiver data word is generated.

* * * * *